US006171134B1

(12) United States Patent
Lai

(10) Patent No.: US 6,171,134 B1
(45) Date of Patent: Jan. 9, 2001

(54) MULTIPLE CONDUCTOR CABLE CONNECTOR

(75) Inventor: Chin-Te Lai, Tao-Yuan (TW)

(73) Assignee: Hon Hai Precision Ind. Co., Ltd., Taipei Hsein (TW)

( * ) Notice: Under 35 U.S.C. 154(b), the term of this patent shall be extended for 0 days.

(21) Appl. No.: 09/306,011

(22) Filed: May 5, 1999

(30) Foreign Application Priority Data

Feb. 11, 1999 (TW) ..... 88202428

(51) Int. Cl.[7] ..... H01R 4/24; H01R 4/26; H01R 11/20

(52) U.S. Cl. ..... 439/405; 439/607

(58) Field of Search ..... 439/405, 610, 439/607, 404

(56) References Cited

U.S. PATENT DOCUMENTS 5,118,306 * 6/1992 Bixler et al. ..... 439/405
5,123,859 * 6/1992 Davis et al. ..... 439/405
5,536,182 * 7/1996 Atoh et al. ..... 439/404
5,766,033 * 6/1998 Davis ..... 439/405
6,062,907 * 5/2000 Tan et al. ..... 439/610

* cited by examiner

*Primary Examiner*—Neil Abrams
*Assistant Examiner*—Michael C. Zarroli
(74) *Attorney, Agent, or Firm*—Wei Te Chung

(57) ABSTRACT

The present invention relates to a multiple conductor cable connector comprising a front insulative housing, a rear insulative housing, a number of contacts each comprising a piercing section and a connecting section, a pair of latching components and a shell comprising a base plate, a shielding section and a pair of latching arms. The front housing comprises a base board and a mating section forwardly projecting from the base board for mating with a mating connector. The rear insulative housing has a chamber for partially receiving the latching arms of the shell thereof. Several positioning holes are defined in the latching arms for latching with corresponding positioning members.

8 Claims, 9 Drawing Sheets

MULTIPLE CONDUCTOR CABLE CONNECTOR

BACKGROUND OF THE INVENTION

The present invention relates to a cable connector, and especially to a cable connector for terminating multiple conductive wires.

Cable connectors are common components in electronic systems. A conventional cable connector is disclosed in Taiwan Patent Application No. 78110089. Such connectors generally comprise contacts having piercing structures which pierce through insulated conductive wires thereby electrically connecting with conductors thereof for communicating signals. Insulative housings of conventional cable connectors usually adopt a riveting process to connect with corresponding shells. However, since the riveting process requires additional riveting tools, manufacture and assembly of the cable connectors is complicated.

Thus, an improved prior cable connector having an insulative housing and a shell combined together by a latching is provided. Referring to FIG. 1, in which an upper securing member is omitted for the sake of clarity, a conventional cable connector 8 includes an insulative housing 80, a shell 82, a plurality of contacts 84, an upper securing member and a lower securing member 86. The housing 80 has a base plate 800 defining cutouts 802 in an upper surface and a lower surface. The shell 82 forms a plane surface 820 engaged to a side of the base plate 800 of the housing 80. A pair of mounting ears 822 extend proximate opposite ends of the plane surface 820 for engaging the cutouts 802 of the housing 80 whereby the housing 80 is assembled to the shell 82. However, the positioning members 822 are bent spring clips susceptible to resilient deformation. Thus, a sufficient latching force may be difficult to provide in the mating direction of the cable connector 8 and a mating connector, thereby causing the shell 82 to become disconnected from the housing 80.

BRIEF SUMMARY OF THE INVENTION

A main object of the present invention is to provide a cable connector comprising at least an insulative housing firmly latched with a D-shaped shell having a pair of positioning members for assembling the shell with the housing and integrally combining the shell with the other components of the cable connector.

In accordance with one aspect of the present invention, a cable connector comprises a front insulative housing, a rear insulative housing, a shell, a plurality of contacts and a pair of positioning members. The front insulative housing includes a base board and a mating section projecting from the base board. The mating section defines an upper row of engaging slots and a lower row of engaging slots through the base board. The rear insulative housing is assembled to the front housing from the base board, and forms a joining section for being assembled with the base board of the front housing and a main body extending rearwardly from the joining section. The main body comprises a receiving section and two joining sections extending from opposite ends of the main body. The receiving section forms a plurality of receiving slots corresponding to the engaging slots of the front housing thereby forming a plurality of common receiving slots for receiving corresponding contacts. Each contact comprises a piercing section and a joining section. The shell forms a base plate and is assembled to the housing from one side of the mating section of the front housing. A shielding section forwardly protrudes from a middle portion of the base plate. A pair of latching arms rearwardly extend from opposite ends of the base plate for being partially received in the chamber of the rear housing and engaging with the positioning members positioned in the positioning holes of the rear housing.

Other objects, advantages and novel features of the invention will become more apparent from the following detailed description when taken in conjunction with the accompanying drawings.

DETAILED DESCRIPTION OF THE INVENTION

Figure 1:
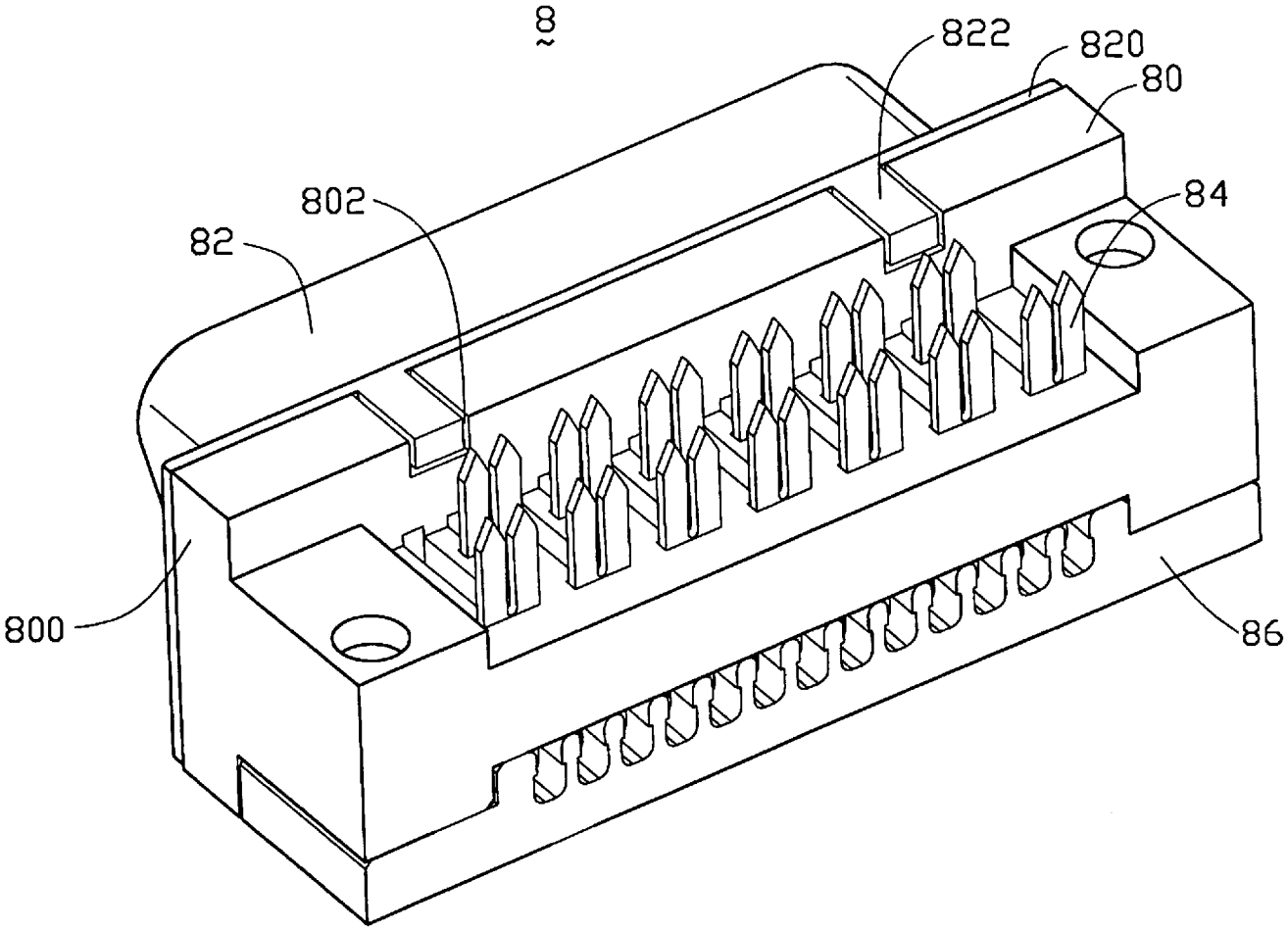
FIG. 1 (PRIOR ART)
FIG. 1 is a perspective view of a conventional cable connector.
Figure 2:
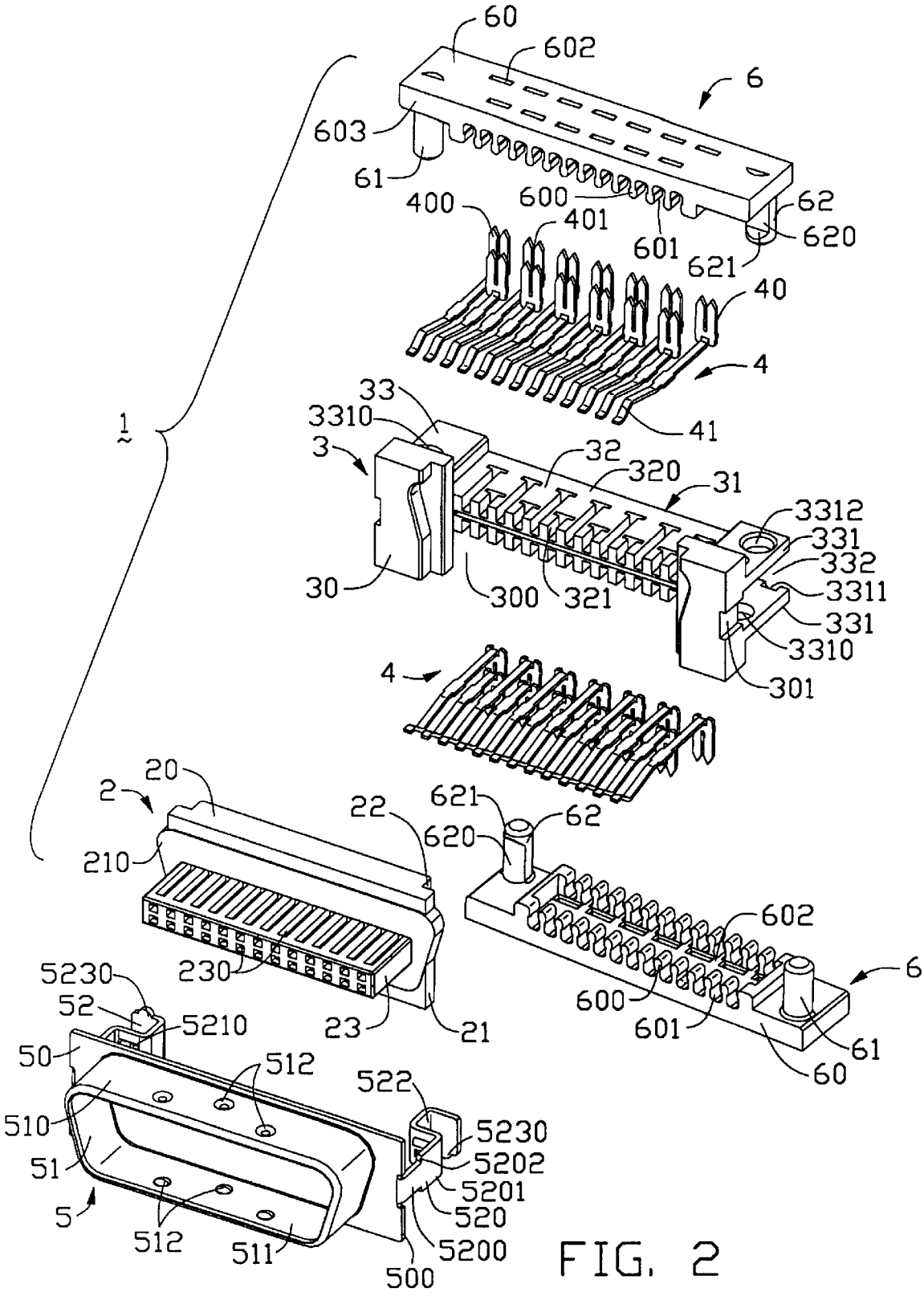
FIG. 2 is an exploded view of a cable connector in accordance with the present invention.
Figure 3:
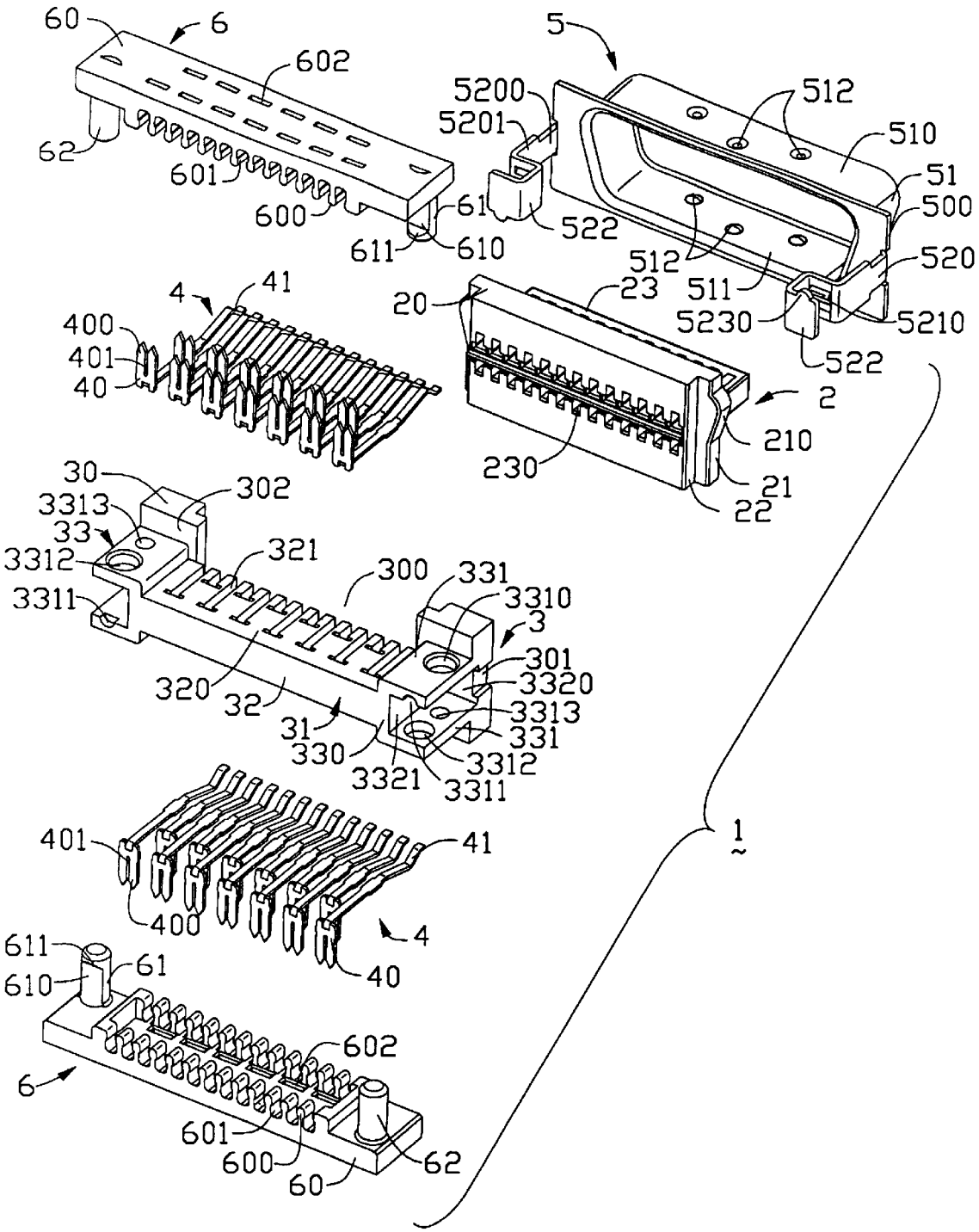
FIG. 3 is similar to FIG. 2 taken from a different perspective.
Figure 4:
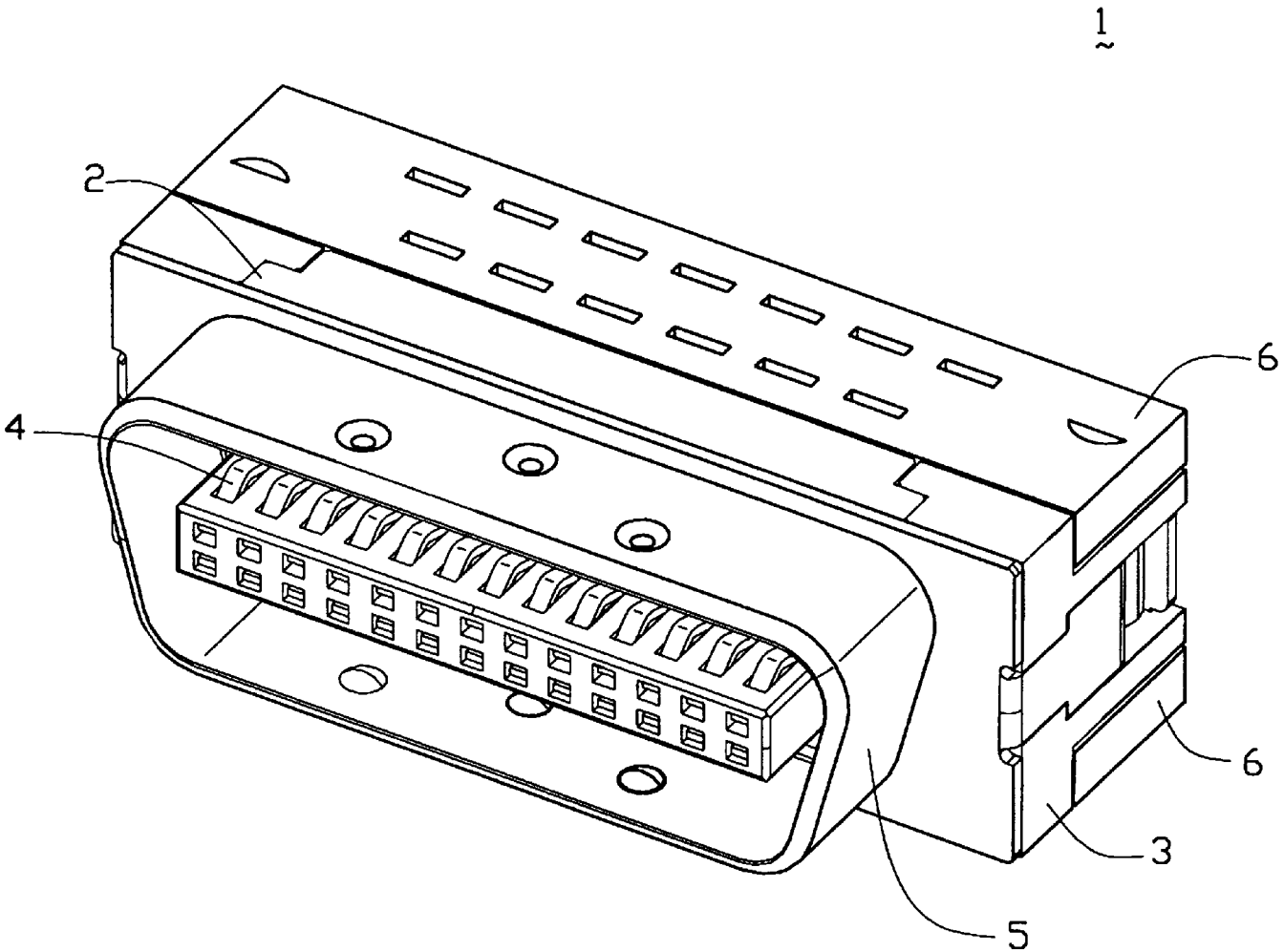
FIG. 4 is an assembled view of FIG. 2.
Figure 5:
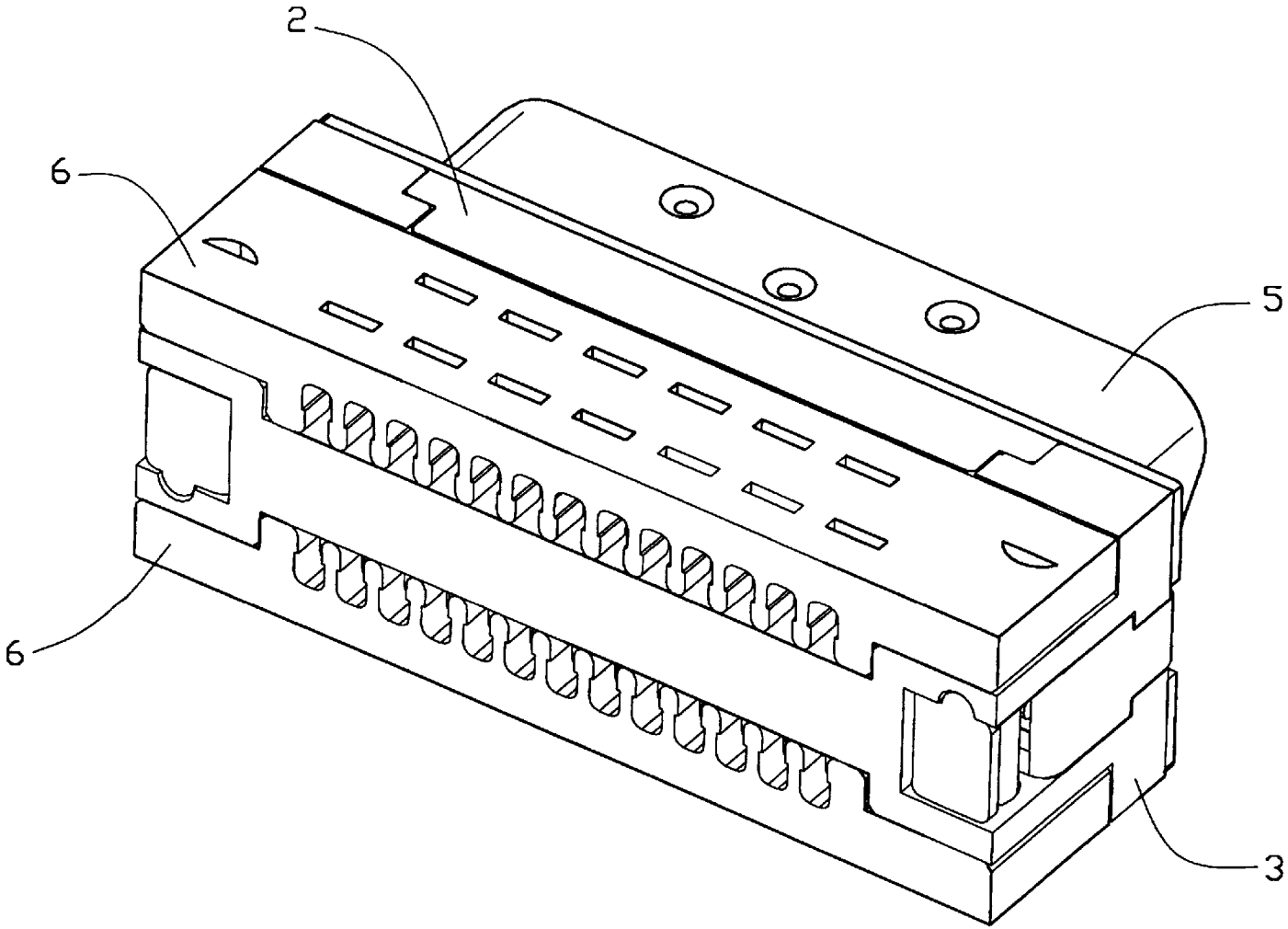
FIG. 5 is an assembled view of FIG. 3.

Referring to FIGS. 2, 3, 4 and 5, a cable connector 1 in accordance with the present invention comprises a front insulative housing 2, a rear insulative housing 3, a plurality of contacts 4 aligned in upper and lower rows, a shell 5 and upper and lower positioning members 6.

The contacts 4 are separated into an upper group and a lower group, each group being divided into two rows. Each contact 4 has a piercing section 40 joined by a connecting section 41 for electrically connecting with a mating connector. Two sharp-flanged ends 400 are formed at a free end of each piercing section 40 for cutting through an insulation of a mating wire thereby electrically contacting conductors thereof. A rift 401 is defined between the two sharp-flanged ends 400.

The front housing 2 comprises a ladder-like base board 20 including a wide front base board 21 and a narrow rear base board 22 sharing a top surface with the front base board 21. A pair of arcuate shoulders 210 are formed on opposite ends of the front base board 21. A mating section 23 perpendicularly projects outward from the front base board 21 and forms upper and lower rows of engaging slots 230 through the front and rear base boards 21, 22. The connecting sections 41 of the contacts 4 are received in the corresponding engaging slots 230.

Figure 6:
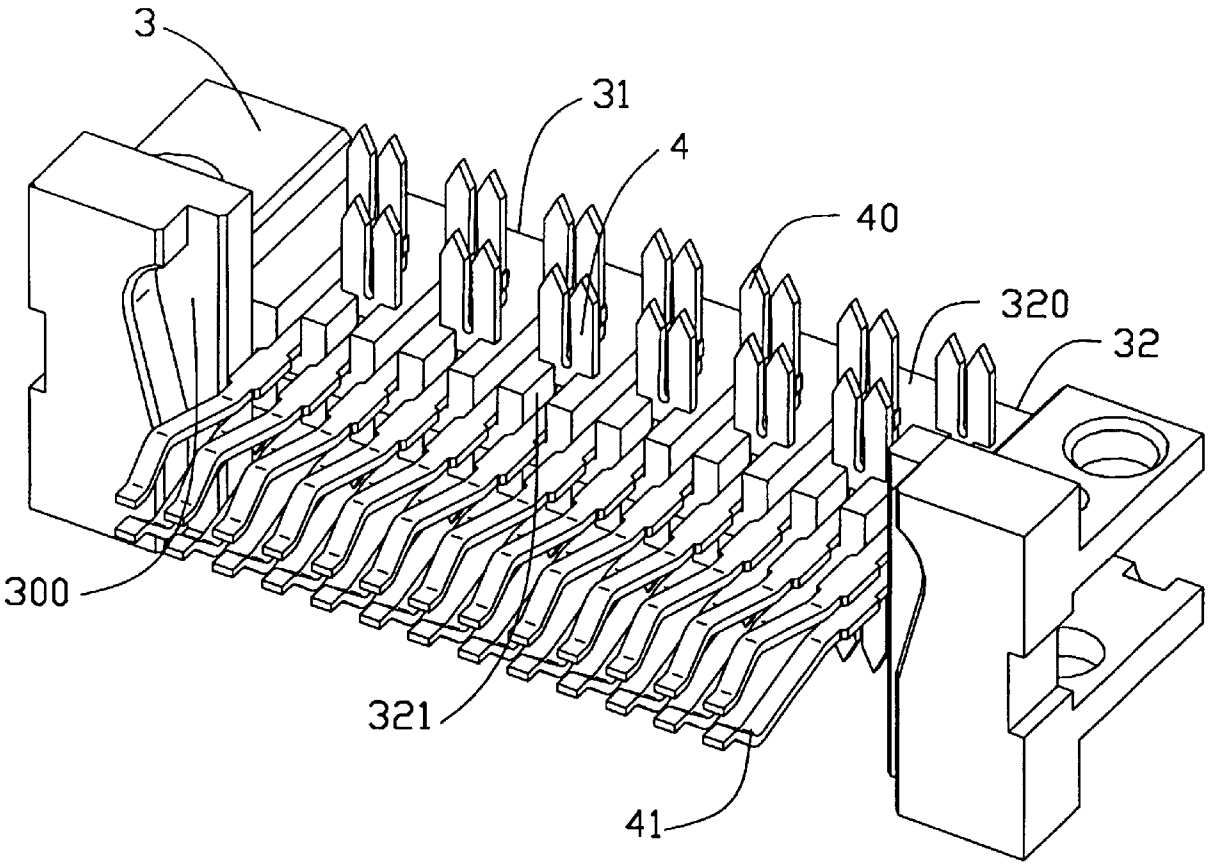
FIG. 6–FIG. 9 are sequential views of the cable connector showing the assembly thereof.
Figure 7:
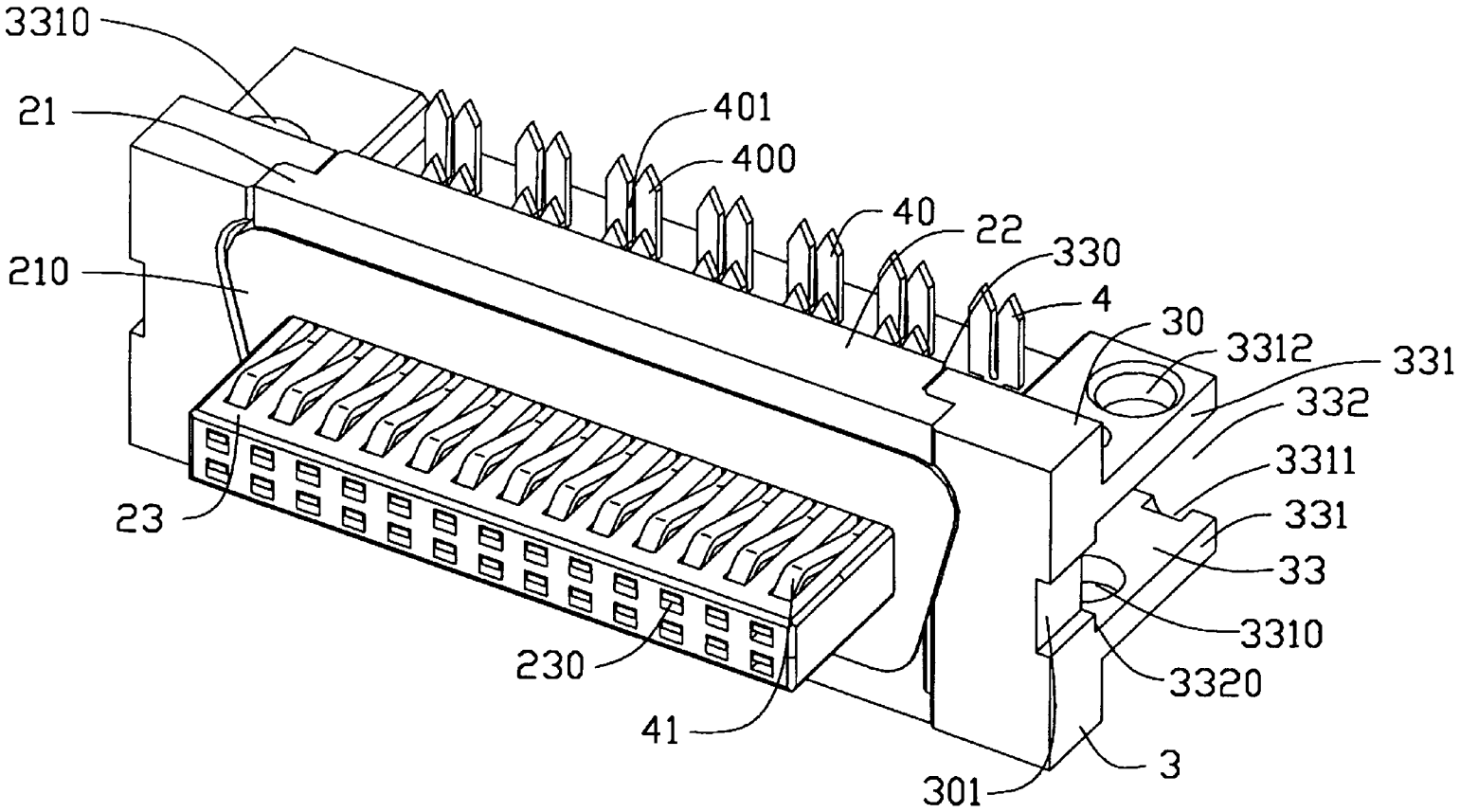
Figure 8:
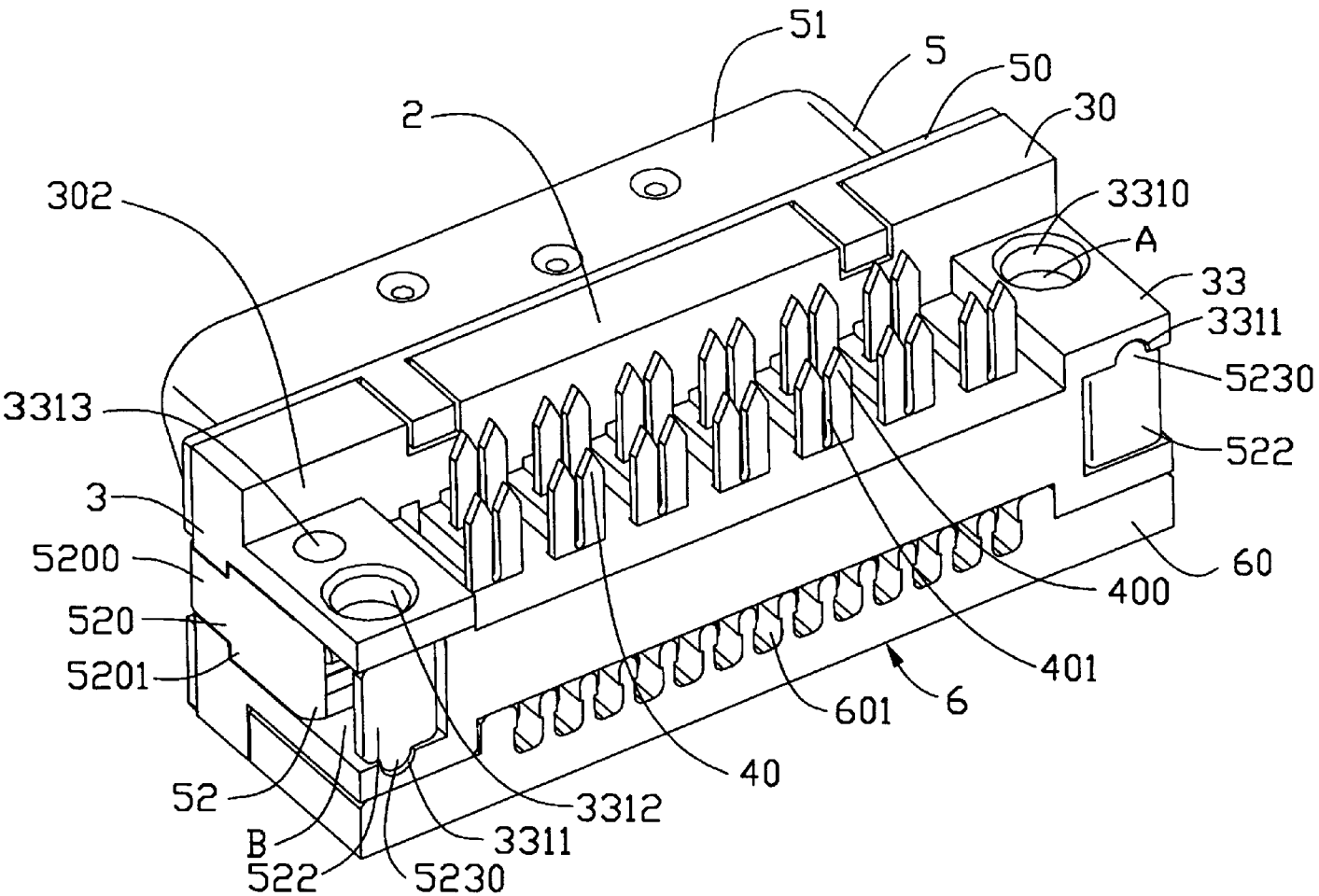
Figure 9:
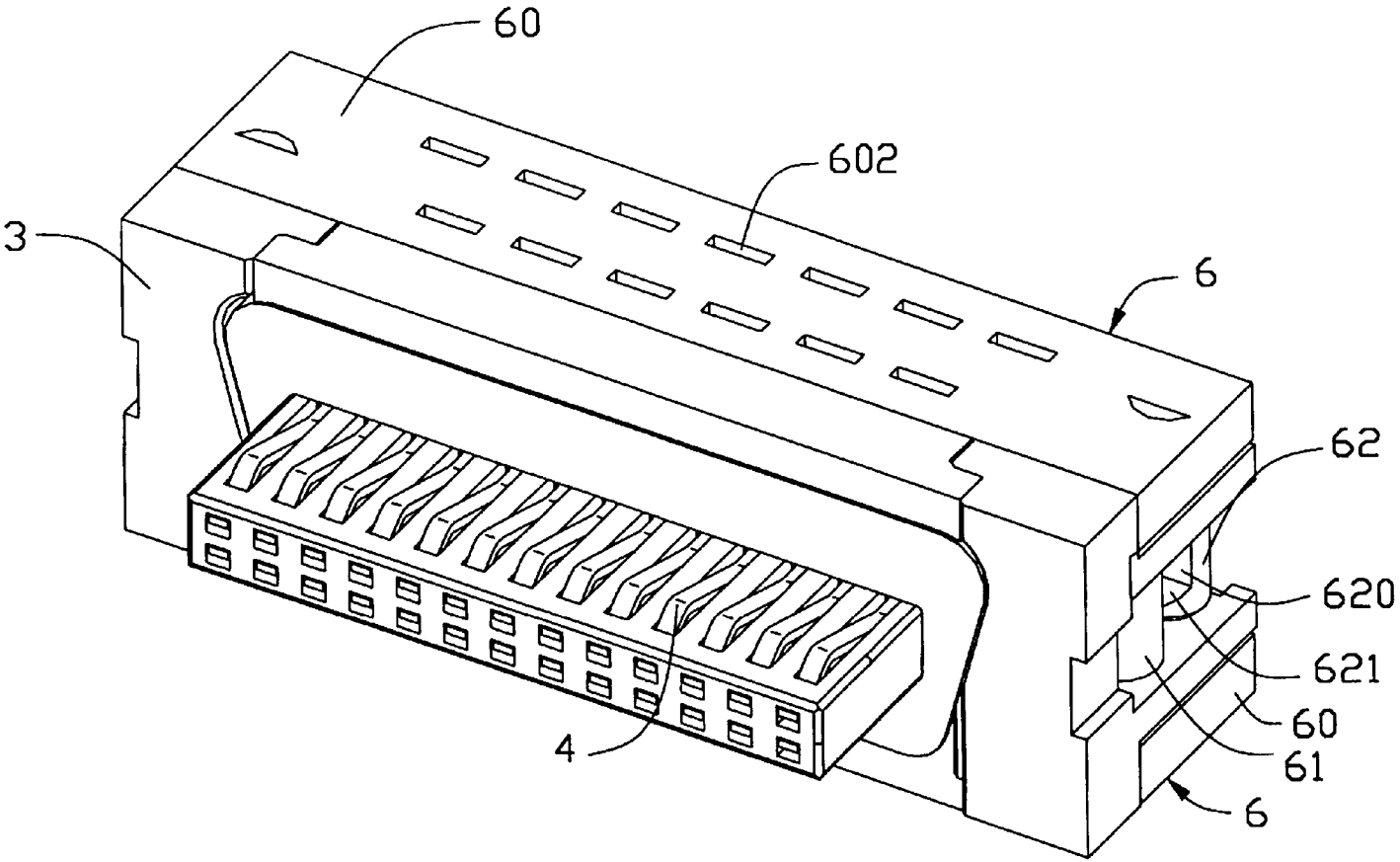

Also referring to FIGS. 6 and 7, the rear housing 3 includes a pair of joining sections 30 for joining with the base board 20 of the front housing 2 and a main body 31 perpendicularly projecting outward from a rear surface of the joining section 30. Each joining section 30 has the same height and thickness as the height and thickness of the base board 20 of the front housing 2. An opening 300 is defined between the pair of joining sections 30 having the same configuration as the peripheral configuration of the base board 20 thereby closely engaging the front and rear housings 2, 3 together by inserting the base board 20 into the opening 300 of the rear housing 3. A channel 301 is defined in a middle portion of an exterior side wall of each joining section 30. The main body 31 comprises a receiving section 32 and a pair of assembling sections 33 formed on opposite ends of the receiving section 32. The assembling sections 33 extend slightly beyond top and bottom surfaces of the receiving section 32. The receiving section 32 has a pair of opposite upper and lower mating surfaces 320. An upper row and a lower row of receiving slots 321 are formed in the receiving section 32 corresponding to the engaging slots 230 of the front housing 2 for receiving corresponding contacts 4 therein. The sharp-flanged ends 400 of the contacts 4 extend beyond the mating surfaces 320 of the receiving section 32 of the rear housing 3 and the connecting sections 41 of the contacts 4 forwardly extend from the receiving slots 321 of the receiving section 32.

The base board 20 of the front housing 2 is inserted into the opening 300 between the pair of joining sections 30 of the rear housing 3 thereby forming a plurality of common contact receiving passageways by aligning the receiving slots 321 of the rear housing 3 with the engaging slots 230 of the front housing 2. The connecting sections 41 of the contacts 4 extend into the corresponding engaging slots 230 of the front housing 2 from the rear base board 22. The projecting shoulders 210 of the front base board 21 of the front housing 2 cooperates with the opening 300 of the joining section 30 of the rear housing 3 thereby firmly assembling the front housing 2 to the rear housing 3 and preventing disorientation therebetween.

The assembling section 33 comprises a joining board 330, upper and lower assembly boards 331 and a chamber 332. The joining board 330 extend from the receiving section 32. A positioning hole 3310 is defined in the upper assembly board 331 of one of the assembly sections 33 proximate the joining section 30. An arcuate recess 3311 is defined in the upper assembly board 331 opposite the positioning hole 3310. A positioning hole 3312 having the same diameter as the positioning hole 3310 is formed in the lower assembly board 331 of the assembling section 33 and distanced from the joining section 30. A smaller positioning hole 3313 is defined at an appropriate position in the lower assembly board 331 proximate the joining section 30. The other assembling section 33 has an identical structure only inverted thus a detailed description thereof is omitted herein. The chamber 332 includes a front abutting side wall 3320 and an inner side wall 3321.

The shell 5 fixed to the front housing 2 comprises a base plate 50, a shielding section 51 for shielding the mating section 23 of the front housing 2 and two latching arms 52. The shielding section 51 is a hollow column forwardly and perpendicularly protruding from the base plate 50, comprising a wider upper flange 510 and a narrow lower flange 511. A plurality of recesses 512 is defined in the upper and lower flanges 510, 511. The latching arms 52 extend from opposite edges of the base plate 50 and each consists of a connecting portion 520 and an engaging portion 522. The connecting portion 520 has a narrow end 5200 joining with the base plate 50 and a wide end 5201 joining with the engaging portion 522. The wide end 5201 forms a front side surface 5202. A pair of projecting bars 5210 is formed on the engaging portion 522 proximate the connecting portion 520. A protruding flange 5230 extends from a lower edge of a free end of one engaging portion 522 and an upper edge of the other engaging portion 522 corresponding to the arcuate recess 3311 of the assembling sections 33 of the rear housing 3.

Referring to FIGS. 2, 3, 7 and 8, after the front and rear housings 2, 3 are assembled with the contacts 4, the shell 5 is fixed to the front and rear housings 2, 3 from a front side of the front housing 2. The base plate 50 abuts against the front base board 20 of the front housing 2 and front side walls of the joining sections 30 of the rear housing 3. The shielding section 51 encloses the periphery of the mating section 23 of the front housing 2. The latching arms 52 engage with the assembling sections 33 of the rear housing 3. The narrow end 5200 of the connecting portion 520 is received in the channel 301 of the rear housing 3 and the front side surface 5202 of the wide end 5201 abuts against the front abutting side wall 3320 of the chamber 332 of the rear housing 3. The engaging portion 522 abuts against the inner abutting side wall 3321 of the chamber 332, and the protruding flange 5230 engages with the corresponding recess 3311 of the assembling section 33 thereby firmly fixing the shell 5 and the front and rear housings 2, 3 together. Thus, the latching arms 52 of the shell 5 divide each chamber 332 into two spaces A and B.

Referring back to FIGS. 2 and 3, the positioning members 6 are fixed to the main body 31 of the rear housing 3 for enforcing the sharp-flanged ends 400 of the piercing sections 40 of the contacts 4 to pierce into corresponding mating wires (not shown). Each positioning member 6 has a base 60. Two rows of wire securing bodies 600 project from a mating surface of the base 60 to mate with the main body 31 of the rear housing 3. A wire receiving slot 601 is defined between adjacent wire securing bodies 600 and exposed toward corresponding receiving slots 321 of the rear housing 3. A plurality of apertures 602 is defined in the base 60 for securing the piercing sections 40 of the corresponding contacts 4. A first positioning post 61 and a second positioning post 62 are formed on the mating surface of the base 60 at locations corresponding to the positioning holes 3310, 3312 of the assembling sections 33, respectively. A flat plane 610, 620 is formed on an outer surface of each positioning post 61, 62 from the base 60 toward free ends thereof thereby forming latching ends 611, 621.

Referring to FIGS. 2, 3, 7 and 9, after the shell 5 is fixed to the front and rear housings 2, 3, the upper positioning member 6 engages the rear housing 3. A front side surface 603 of the base 60 abuts against the rear side wall 302 of the joining section 30. The first positioning post 61 is inserted into the space A via the positioning hole 3310. The latching end 611 engages the projecting bar 5210 of the engaging portion 522 of the corresponding latching arm 52. The distal end of the first positioning post 61 abuts against the smaller hole 3313 of the assembling section 33. The second positioning post 62 is inserted into the space B via the positioning hole 3312. The latching end 621 engages the projecting bar 5210 of the engaging portion 522 of the corresponding latching arm 52 thereby firmly assembling the latching arms 52 to the rear housing 3. The sharp-flanged ends 40 of the contacts 4 are inserted into the corresponding apertures 602 of the base 60 of corresponding positioning members 6. The mating wires are received in the wire receiving slots 601 and pressed into the rifts 401 between adjacent piercing sections 41 of the contacts 4 whereby the sharp-flanged ends 400 of corresponding piercing sections 41 cut through the insulation of the mating wires thereby electrically contacting with the conductors of the corresponding wires.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

a front insulative housing having a base board, a mating section forwardly projecting from the base board for mating with a mating connector, upper and a lower engaging slots defined through the base board;

a rear insulative housing including a main body and a pair of joining sections formed at opposite ends of the main body for engaging with the base board of the front insulative housing, the main body comprising a receiving section, a pair of assembling sections extending from opposite ends of the receiving section, and upper and lower receiving slots defined in the receiving section and aligned with the engaging slots of the front insulative housing to form receiving passageways for receiving corresponding contacts;

a plurality of contacts each comprising a piercing section for piercing an insulation of a mating wire and a connecting section for electrically connecting with a mating connector;

a pair of positioning members fixed to the main body of the rear insulative housing for forcing the mating wires to engage the piercing sections of corresponding contacts; and a shell comprising a base plate, a shielding section forwardly projecting from the base plate, and a pair of latching arms projecting in a direction opposite to the shielding section from opposite ends of the base plate for securing the front insulative housing, the rear insulative housing and the positioning members together.

2. The cable connector as claimed in claim 1, wherein each latching arm of the shell consists of a connecting portion extending from opposite edges of the base plate and an engaging portion integrally joining with the connecting section, each engaging portion forming a projecting bar formed on an inner surface of the engaging portion proximate the connecting portion for engaging with the corresponding positioning member, and a protruding flange extending from an edge of a free end of the engaging portion for engaging with the rear dielectric housing.

3. The cable connector as claimed in claim 2, wherein the base board of the front insulative housing comprises a wide front base board and a narrow rear base board sharing a top surface with the front base board, a pair of arcuate shoulders formed on opposite ends of the front base board, a mating section perpendicularly projecting outward from the front base board and forming upper and lower rows of engaging slots through the front and rear base boards thereby receiving the joining sections of corresponding contacts.

4. The cable connector as claimed in claim 3, wherein each assembling section of the main body of the rear insulative housing comprises a joining board extending from the receiving section for engaging with the front dielectric housing, upper and lower assembly boards for engaging with the positioning members.

5. The cable connector as claimed in claim 4, wherein the upper assembly board of one of the assembly sections defines a positioning hole therein proximate the joining section, an arcuate recess in an opposite edge of the joining section and an upper positioning hole, while the lower assembly board of the same assembly section defines a lower positioning hole having the same diameter as the upper positioning hole and distanced from the joining section and a smaller positioning hole proximate the joining section.

6. The cable connector as claimed in claim 5, wherein each joining section of the rear insulative housing has the same height and thickness as the height and thickness of the base board of the front housing, an opening defined between the pair of joining sections having the same configuration as the peripheral configuration of the base board thereby closely engaging the front and rear housings together by inserting the base board into the opening of the rear housing.

7. The cable connector as claimed in claim 6, wherein the base of each positioning member forms two rows of wire securing bodies projecting from a mating surface to mate with the main body of the rear housing, and defining a wire receiving slot between adjacent wire securing bodies exposing toward corresponding receiving slots of the rear housing.

8. The cable connector as claimed in claim 7, wherein the base of each positioning member defines a plurality of apertures thereon for securing the piercing sections of corresponding contacts and forms a first positioning post and a second positioning post on the mating surface at locations respectively for engaging with the corresponding positioning holes of the assembling sections of the rear dielectric housing and a flat plane on an outer surface of each positioning post from the base toward free ends thereof thereby forming latching ends for engaging with corresponding protruding bars of the latching arms.

* * * * *